United States Patent [19]

Mito et al.

[11] Patent Number: 4,977,773

[45] Date of Patent: Dec. 18, 1990

[54] DOUBLE ACTION DIE SET FOR CLOSED FORGING

[75] Inventors: Yoshiki Mito; Minoru Sueda; Hiroshi Shiota; Shozo Tashiro, all of Hiroshima, Japan

[73] Assignee: Mitsubishi Jukogyo Kabushiki Kaisha, Tokyo, Japan

[21] Appl. No.: 403,489

[22] Filed: Sep. 6, 1989

[30] Foreign Application Priority Data

Sep. 13, 1988 [JP] Japan ..... 63-227420

[51] Int. Cl.[5] ..... B21J 9/12

[52] U.S. Cl. ..... 72/353.6; 72/407

[58] Field of Search ..... 72/354, 358, 359, 407

[56] References Cited

U.S. PATENT DOCUMENTS 3,064,507 11/1962 Strugala et al. ..... 72/354

4,274,276 6/1981 Mettler ..... 72/354

4,321,818 3/1982 Bessho ..... 72/354

*Primary Examiner*—Lowell A. Larson

*Attorney, Agent, or Firm*—Wenderoth, Lind & Ponack

[57] ABSTRACT

A double action die set for closed forging to be equipped in a reciprocating press consisting of a stationary base and a slide. Each die is equipped with one set of a metal mold and a punch. A stationary side die is fixedly secured to the stationary base, while a movable side die is fixedly secured to the slide. Each one of the stationary side die and the movable side die comprises therein a metal mold supporting outer piston of hollow shape, a punch supporting inner piston slidably engaged with a hollow space in the outer piston, and a common oil chamber for supporting the outer piston and the inner piston with a same hydraulic pressure.

According to this invention such advantages as to reduce the height of the die set and to move the pressurized oil only within the same oil chambers can be obtained.

12 Claims, 6 Drawing Sheets

DOUBLE ACTION DIE SET FOR CLOSED FORGING

BACKGROUND OF THE INVENTION:

1. Field of the Invention:

The present invention relates to a double action die set in a closed forging press.

2. Description of the Prior Art:

One example of a double action die set in a closed forging press in the prior art is illustrated in FIGS. 4 to 6. FIG. 4 shows an opened state of a die set before pressing, FIG. 5 show the state when pressing has completed, and FIG. 6 is a cross-section view showing an opened state of a die set after pressing. With reference to these figures, in a press consisting of a stationary base 1 and a slide 2 that is reciprocated by crank action or the like, a double action die set in the prior art is composed of a stationary side die 5 fixedly provided on the stationary base 1 and provided with an oil chamber 3, a piston 4 supported by a hydraulic pressure in the oil chamber 3, and a knock-out piston 43 slidably engaged with a rod portion of the piston 4 therein, a movable side die 10 fixedly provided on the slide 2 and provided with an oil chamber 6, a piston 7 supported by a hydraulic pressure in the oil chamber 6, an oil chamber 8 and a piston 9 supported by a hydraulic pressure in the oil chamber 8 therein, an outer metal mold 51, an inner metal mold 44, a metal mold 12, and punches 13 and 14. On a main body surface 15 of the stationary side die 5 is fixedly provided the outer metal mold 51, the inner metal mold 44 slidably fitted to the inner diameter portion of the outer metal mold 51 is also supported on the main body surface 15, the inner metal mold 44 is supported by the knock-out piston 43, the punch 13 is fixedly secured to the piston 4, the metal mold 12 is fixedly secured to the piston 7 of the movable side die 10, and the punch 14 is fixedly secured to the piston 9.

To the pistons 4 and 9 are respectively connected oil paths of pull-back hydraulic pressures 16 and 17, and the oil chambers 3, 6 and 8 are all connected through one closed hydraulic circuit 18. To this hydraulic circuit 18 is connected a hydraulic pressure generator normally through a check valve 19, and a pressure relief valve 21 is equipped to the hydraulic circuit 18. An oil chamber 46 on the opposite side of the knock-out piston 43 to the piston 4 is connected to a hydraulic pressure device 47 via a switching valve 45.

When a raw material 22 is charged within the outer metal mold 51 and the inner metal mold 44 by means of a forging raw material feeder not shown and the slide 2 is actuated in the closing direction indicated by an arrow P in FIGS. 4 and 5 by means of a drive unit not shown, the outer metal mold 51 and the metal mold 12 would join together, and a closed space 23 is formed. Furthermore, as the actuation of the slide 2 proceeds, the pressurized oil within the oil chamber 6 would move to the oil chambers 3 and 8 via the closed hydraulic circuit 18 as distributed depending upon pressure balance among the respective oil chambers, and would actuate the pistons 4 and 9 in the directions indicated by arrows Q in FIG. 5, so that the raw material 22 is pressed by the punches 13 and 14 to be formed into a shaped product 24.

When the slide 2 is actuated in the opening direction indicated by an arrow R in FIGS. 5 and 6 by means of the aforementioned drive unit not shown, the pistons 4 and 9 are respectively restored to their original positions by the pull-back hydraulic pressures 16 and 17 also the pressurized oil in the oil chambers 3 and 8 would move to the oil chamber 6 via the closed hydraulic circuit 18, in addition the metal mold 12 are separated from the outer metal mold 51, resulting in an opened state, due to removal of a pressure in the oil chamber 46 by means of the switching valve 45, the knock-out piston 43 as well as the inner metal mold and the product 24 supported by the piston 43 would rise, and the product 24 is ejected from the inner metal mold 44 by means of a product ejection device not shown and sent to the next step of the process.

However, the double action die set in the prior art as described above is accompanied by a number of shortcomings as will be enumerated in the following:

(1) Since the movable side die 10 has a two-chamber construction including the oil chambers 6 and 8, it is compelled to serially dispose the piston 7 and the piston 9, hence a height of a die becomes high, and the die cannot be equipped in an existing press.

(2) Due to the fact that during operation a large amount of pressurized oil move within the closed hydraulic circuit 18 in a short period of time, a size of pipings would become extremely large, also an operation speed of the press, that is, a number of strokes per minute has a limit, and so, speed-up cannot be achieved.

(3) Since the amounts of pressurized oil moving to the oil chambers 3 and 8, respectively, are different depending upon pressure balance between the oil chambers 3 and 8, and also since the loads applied to the punches 13 and 14 which correspond to these pressures are generally different, a difference is produced between the amounts of movement of the pistons 4 and 9, and poor precision in the products is liable to occur.

(4) As the knock-out of the product 24 is effected by switching the switching valve 45, a necessary operation time becomes long and speed-up of the operation is limited, consumed energy is large, maintenance is laborious, and an existing knock-out drive unit cannot be used.

SUMMARY OF THE INVENTION

It is therefore one object of the present invention to provide a novel double action die set for closed forging which is free from the above-mentioned shortcomings in the prior art.

A more specific object of the present invention is to provide a novel double action die set for closed forging, in which a height of a die is not so high as being unable to be equipped in an existing press, a high operation speed can be realized, precision of forged products is high and energy consumption is small.

According to one feature of the present invention, there is provided a double action die set for closed forging in a reciprocating press consisting of a stationary base and a slide, in which each die is equipped with one set of a metal mold and a punch, a stationary side die is fixedly provided on the stationary base, while a movable side die is fixedly provided on the slide, and each one of the stationary side die and the movable side die comprises therein a metal mold supporting outer piston of hollow shape, a punch supporting inner piston slidably engaged with a hollow space in the outer piston, and a common oil chamber for supporting the outer piston and the inner piston with a same hydraulic pressure.

According to another feature of the present invention, there is provided the above-featured double action die set for closed forging, which is equipped with a piston adapted to generate a hydraulic pressure in response to pressing of one die against the other die, and an accompanying piston connected with the first-mentioned piston through a closed hydraulic circuit so as to move in the same direction as the first-mentioned piston and having a double rod adapted to be pressed respectively against the stationary side outer piston and the movable side outer piston.

According to still another feature of the present invention, there is provided the first-featured double action die set for closed forging, in which a stationary side punch supporting inner piston is formed as a ringshaped piston, and which includes a punch supporting rod having one end slidably engaged with the metal mold supporting outer piston and the other end slidably penetrated through and engaged with the above-mentioned ring-shaped piston and the stationary side die, and having a flange portion for allowing to be supported by the above-mentioned ring-shaped piston.

According to yet another feature of the present invention, there is provided the second-featured double action die set for closed forging, in which the above-mentioned piston adapted to generate a hydraulic pressure in response to pressing of one die against the other die and the aforementioned accompanying piston are provided on either one of the stationary side die and the movable side die.

According to a further feature of the present invention, there is provided the second-featured double action die set for closed forging, in which at an opened state before pressing, the interval between the end surfaces of the stationary side metal mold and the movable side metal mold, the interval between the rod end surface of the aforementioned piston adapted to generate a hydraulic pressure and the opposed die, and the differential length of the interval between the end surfaces of the stationary side outer piston and the movable side outer piston minus the total length of the accompanying piston, are equal to one another.

In the double action die set for closed forging according to the present invention having the abovedescribed structural features, the following advantages are presented:

(1) Since pistons take inner-outer parallel arrangement, the height of the die set can be made low.

(2) Upon actuation of pistons, pressurized oil is only necessitated to move within the same oil chambers.

(3) Owing to the stroke accompanying function realized by the piston adapted to generate a hydraulic pressure in response to pressing of one die against the other die and the accompanying piston connected with the first-mentioned piston through a closed hydraulic circuit and having two rods adapted to be pressed respectively against the stationary side outer piston and the movable side outer piston, the operations of the respective metal mold supporting pistons on the stationary side and on the movable side become identical.

(4) Knock-out of shaped products can be done by means of other drive units outside of the die set.

The above-mentioned and other objects, features and advantages of the present invention will become more apparent by reference to the following description of one preferred embodiment of the invention taken in conjunction with the accompanying drawings.

Figure 4:
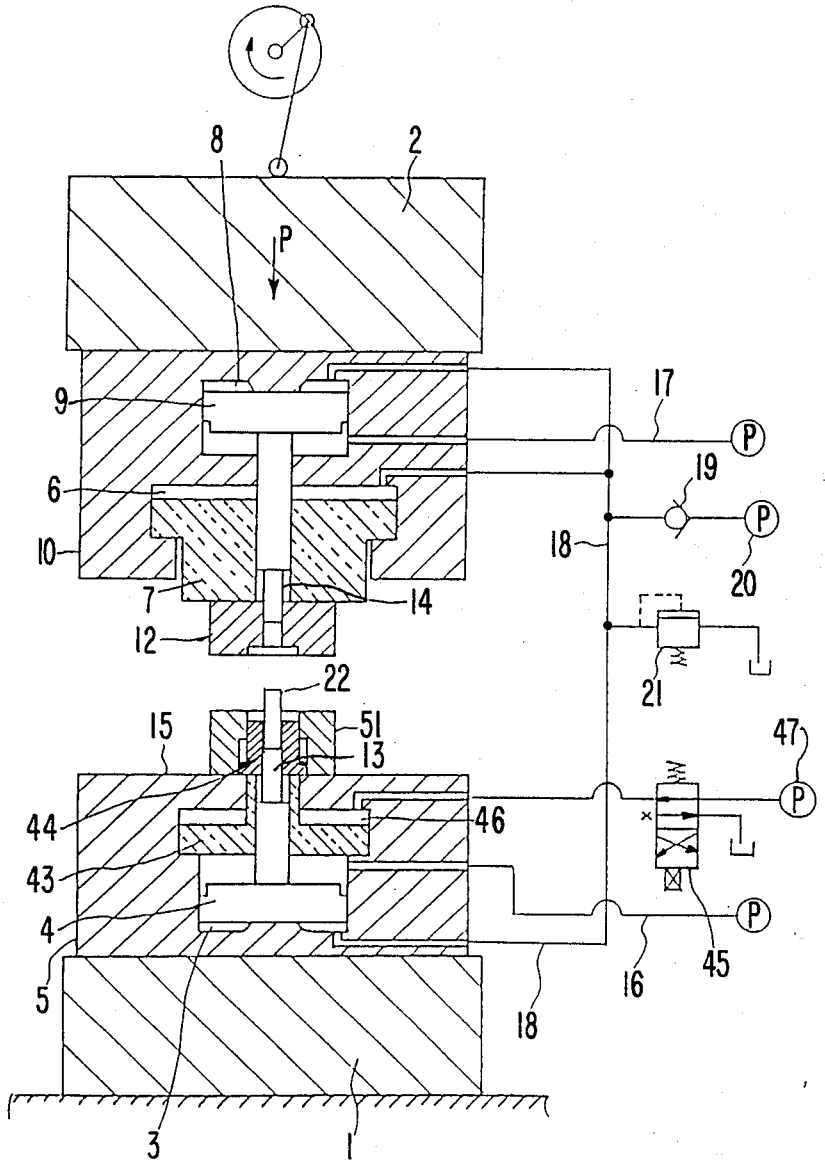
FIG. 4 (PRIOR ART)
FIG. 4 is a vertical cross-section view of one example of the double action die set in the prior art, showing an opened state before pressing.
Figure 5:
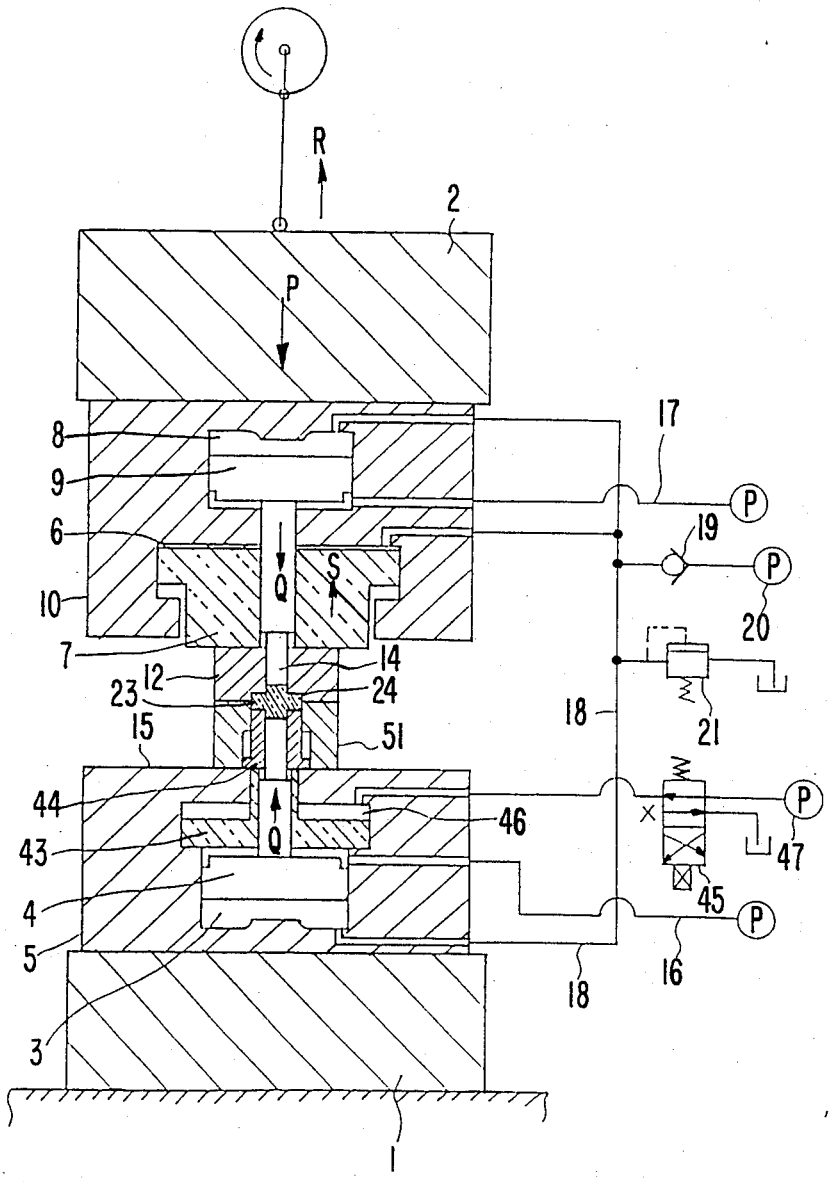
FIG. 5 (PRIOR ART)
FIG. 5 is a similar cross-section view but showing a closed state upon completion of pressing.
Figure 6:
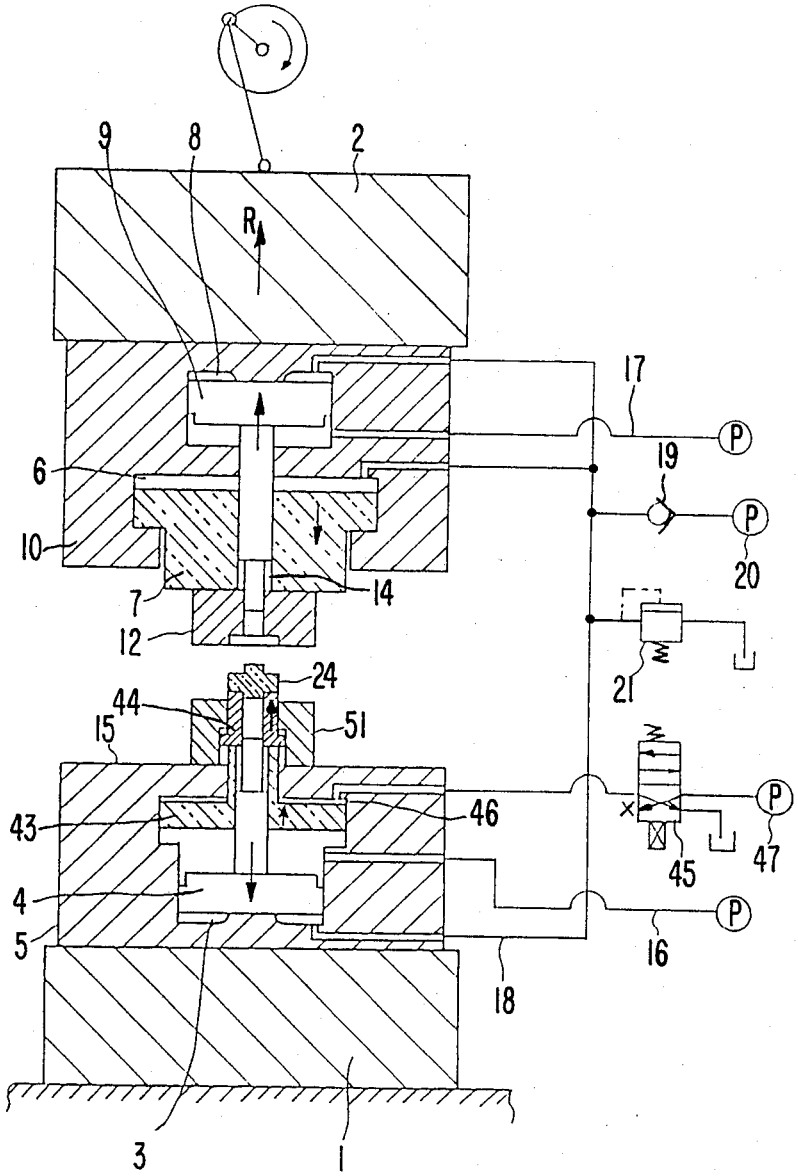
FIG. 6 (PRIOR ART)
FIG. 6 is also a similar cross-section view but showing an opened state after pressing.

DESCRIPTION OF THE PREFERRED EMBODIMENT:

Now one preferred embodiment of the present invention will be described in detail with reference to FIGS. 1 to 3. It is to be noted that component members identical to those of the double action die set in the prior art illustrated in FIGS. 4 to 6 and described above, are given like reference numerals, and further description thereof will be omitted here.

Figure 1:
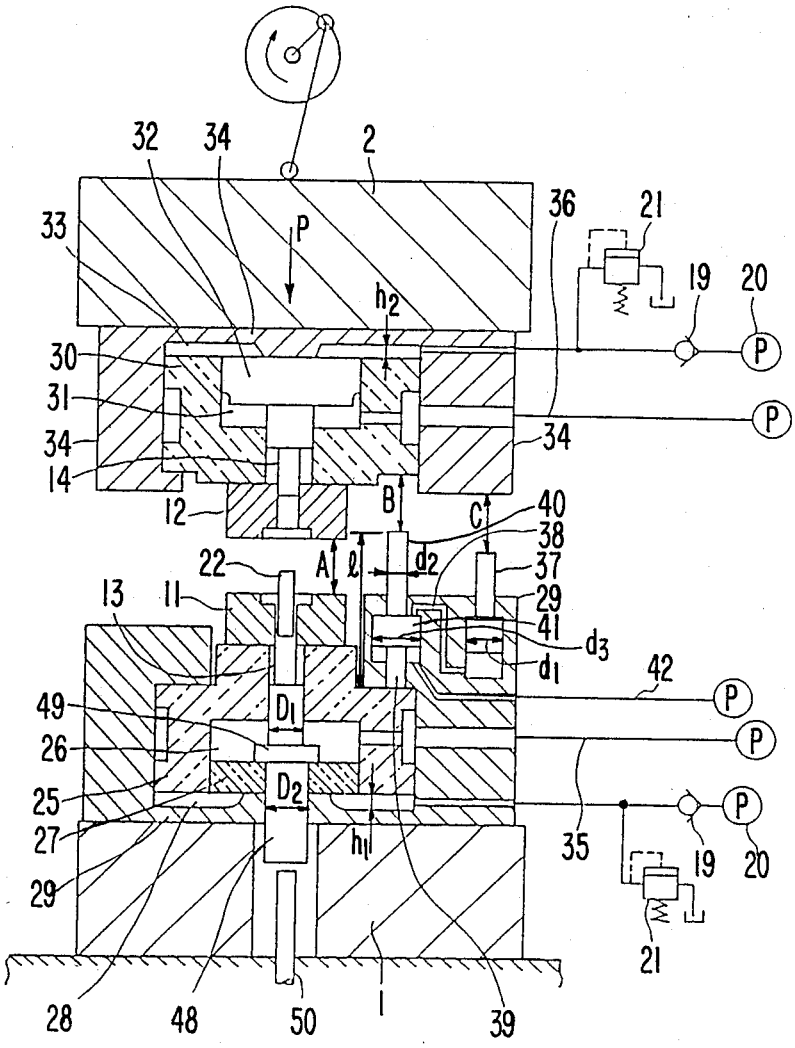
FIG. 1 is a vertical cross-section view of a double action die set according to one preferred embodiment of the present invention, showing an opened state before pressing.
Figure 2:
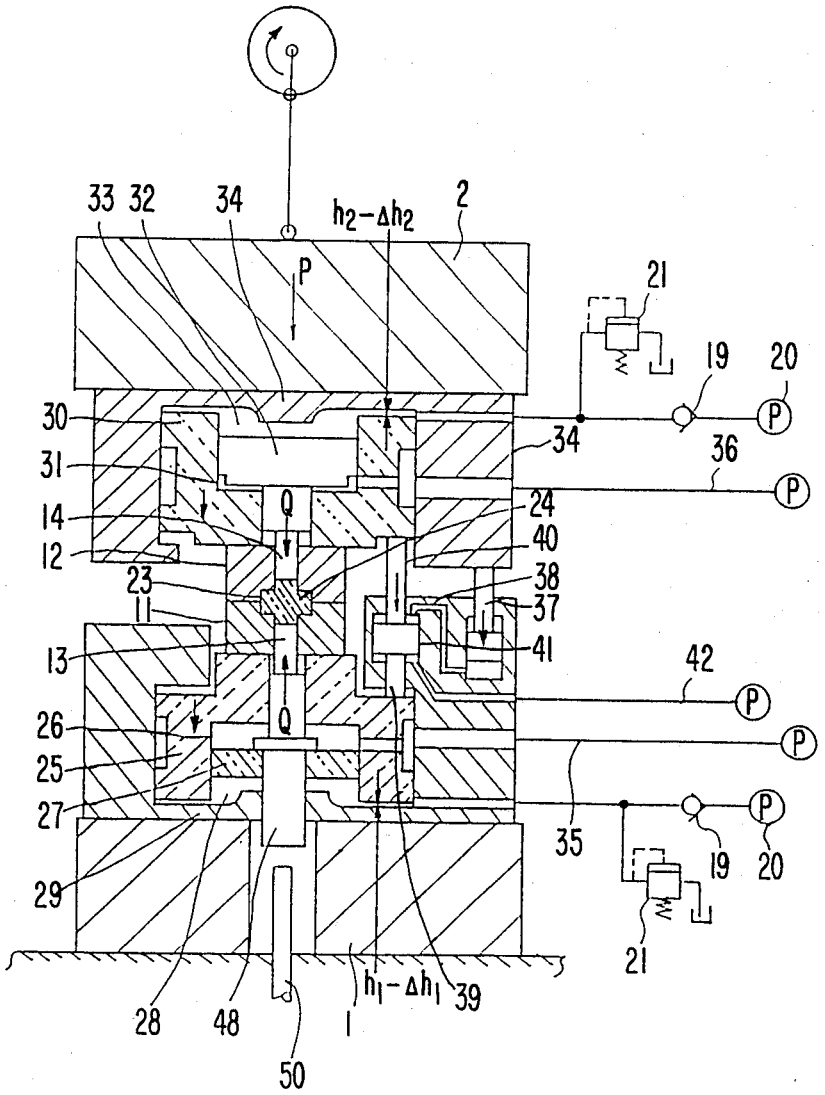
FIG. 2 is a similar cross-section view but showing a closed state upon completion of pressing.
Figure 3:
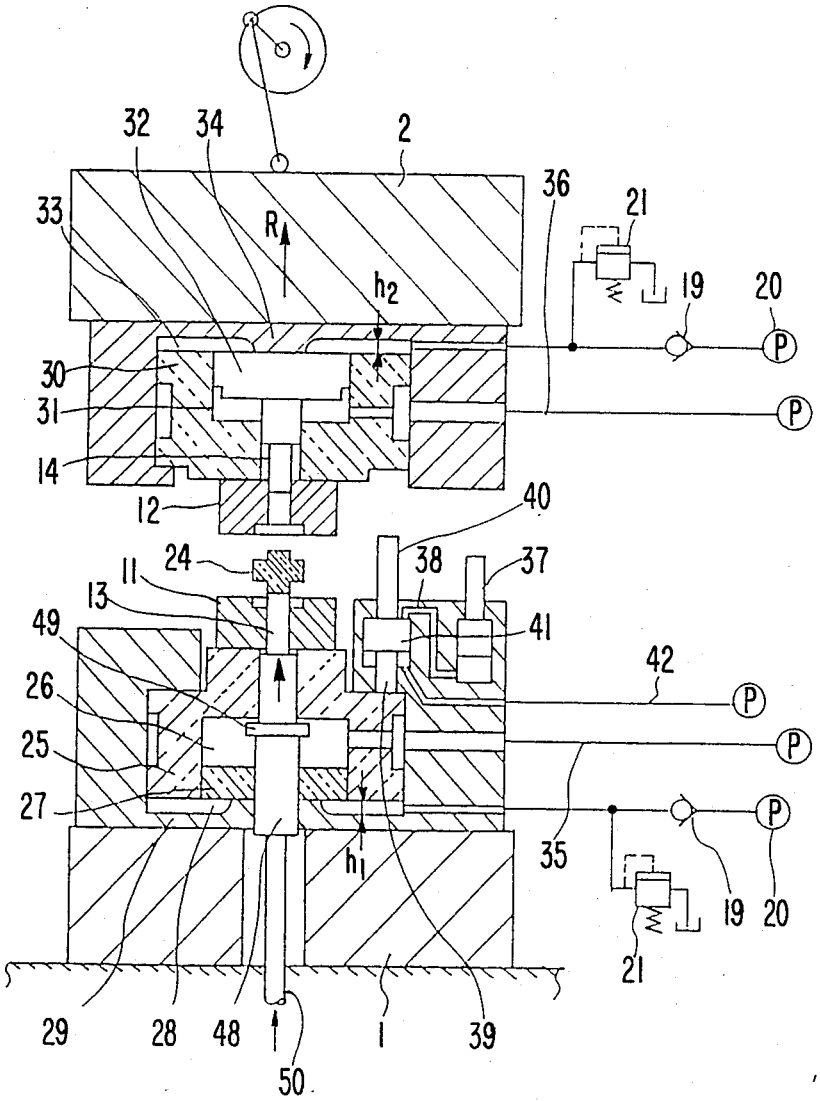
FIG. 3 is also a similar cross-section view but showing an opened state after pressing.

As shown in FIGS. 1 to 3, on a stationary base 1 is fixedly provided a stationary side die 29 comprising therein a hollow outer piston 25, an inner piston 27 which is slidably engaged with a hollow space 26 in the outer piston 25, and a common oil chamber 28 for hydraulically supporting the both pistons 25 and 27 from the same side, and further, the stationary side die 29 is equipped with a rod 48 having one end slidably engaged with the outer piston 25 at a portion of dimension $D_1$ and the other end slidably penetrated through and engaged with the inner piston 27 and the stationary side die 29 at a portion of dimension $D_2$ and including a flange portion for allowing to be supported by the inner piston 27. On the other hand, on a slide 2 is fixedly provided a movable side die 34 comprising therein a hollow outer piston 30, an inner piston 32 which is slidably engaged with a hollow space 31 in the outer piston 30, and a common oil chamber 33 for hydraulically supporting the both pistons 30 and 32 from the same side.

A metal mold 11 is mounted to the outer piston 25 of the stationary side die 29, a punch 13 is mounted to the rod 48, a metal mold 12 is mounted to the outer piston 30 of the movable side die 34, and a punch 14 is mounted to the inner piston 32.

In the above-described construction, as to the dimensional relationship it is assumed that $D_1 < D_2$ is fulfilled.

To the inner pistons 27 and 32 are respectively connected oil paths of pull-back hydraulic pressures 35 and 36, to the oil chambers 28 and 33 are respectively and individually connected hydraulic pressure generators 20 via check valves 19, and also these oil paths are equipped with pressure relief valves 21. The dies or die on the both or either one of the stationary and movable sides, in the illustrated example, the stationary side die 29 is equipped with a piston 37 adapted to generate a hydraulic pressure in response to pressing of the movable side die 34, and an accompanying piston 41 connected to the piston 37 via a closed hydraulic circuit 38 so as to move in the same direction as the piston 37 and including both rods 39 and 40 adapted to be pressed against the stationary side outer piston 25 and the movable side outer piston 30. At an opened state before pressing (See FIG. 1), representing an end surface interval between the metal mold 11 and the metal mold 12 by A, a differential dimension of the end surface interval between the outer piston 25 and the outer piston 30 minus the total length l of the accompanying piston 41 by B, and the interval between the rod end surface of the piston 37 and the end surface of the movable side die 34, then the dimensions A, B and C are chosen to be equal to one another.

To the side of the above-described accompanying piston 41 opposite to the side to which the closed hydraulic circuit 40 is connected, is connected an oil path 42 of pull-back hydraulic pressure. It is to be noted that illustration of the hydraulic pressure generator connected to the respective oil paths 35, 36 and 37 of pull-back hydraulic pressure, is omitted here.

Here if the amounts of necessary strokes of the outer pistons 25 and 30 are represented by $\Delta h_1$ and $\Delta h_2$, respectively, then the apparatus is constructed in such manner that the relation of [the pressure receiving area of the piston]$=\pi/4d_1^2$ and [the pressure receiving area of the accompanying piston 41]$=\pi/4(d_3^2-d_2^2)$ may fulfill the following formula:

$$\pi/4\ d_1^2:\pi/4\ (d_3^2-d_2^2)=\Delta h_1:(\Delta h_1+\Delta h_2)$$

When a raw material 22 is charged within the metal mold 11 by means of a forging raw material feeder and the slide 2 is actuated in the closing direction indicated by an arrow P in FIGS. 1 and 2 by means of a drive unit not shown, the metal mold 11 and the metal mold 12 would join together, and a closed space 23 is formed. As the actuation of the slide 2 proceeds further, the respective outer pistons 25 and 30 moves in the directions indicated by arrows in FIG. 2, also the respective oil heads $h_1$ and $h_2$ in the oil chambers 28 and 33 would reduce, and the pressured oil pushes out the respective inner pistons 27 and 32 in the directions indicated by arrows Q in FIG. 2, so that the raw material 22 is pressed by the punches 13 and 14 and a product 24 can be shaped.

In the above-described operation, simultaneously with the joining of the metal molds 11 and 12, the piston 37 comes into contact with the movable side die 34, and the accompanying piston 41 also comes into contact with the both outer pistons 25 and 30. As the actuation of the slide 2 proceeds further, the piston 37 and the accompanying piston 41 would move in the directions indicated by arrows in FIG. 2.

During the movement also, the both rods 39 and 40 of the accompanying piston 41 continues to be held in contact with the respective outer pistons 25 and 30, and so, it is restrained that a pressure difference between the oil chambers 28 and 33 may be generated and the metal molds 11 and 12 which are respectively fixedly secured to the both outer pistons 25 and 30 may take an overstroke either to the stationary side or to the movable side under the joined condition. The restraining force F is the force $F_1$ generated by the inner pressure of the closed hydraulic circuit 38 minus the force $F_2$ generated by the pull-back hydraulic pressure 42, in the care where an overstroke towards the movable side is about to occur, but it is the force $F_2$ generated by the pull-back hydraulic pressure 42 in the case where an overstroke towards the stationary side is about to occur.

When the slide 2 is actuated in the opening direction indicated by an arrow R in FIG. 3 by means of the above-described drive unit not shown, all the pistons 25, 27, 30, 32, 37 and 41 are respectively restored to their original positions by the pull-back hydraulic pressures 35, 36 and 42, also the metal mold 12 is separated from the metal mold 11, and they take an opened state. Then, the rod 48 is actuated in the direction indicated by arrows in FIG. 3 via a knock-out rod 50 by means of another drive unit not shown, and the shaped product 24 is ejected from the metal mold 11 and is sent to the next step of the process by means of a product processor not shown.

As described in detail above, if the reciprocating press for closed forging according to the present invention is used, the following effects and advantages are obtained:

(1) Since the height of the die is low, a compact die set which can be well mounted to an existing press can be realized.

(2) As the hydraulic pipings of large diameter are unnecessary, reduction of an installation expense as well as simplification of maintenance can be achieved, and also remarkable speed-up of a closed press becomes possible.

(3) Owing to the punch stroke regulating device, precision in the movement of a punch is greatly improved, and realization of high precision of products as well as enhancement of an yield become possible (4) Use of an existing knock-out drive unit becomes possible, hence speed-up, energy saving and simplification of maintenance can be achieved.

While the present invention has been described in detail above in connection to one preferred embodiment of the invention, it is a matter of course that the present invention should not be limited to only the illustrated embodiment, but various changes and modifications in design can be made within the scope of the technical concept of the present invention.

What is claimed is:

1. A double action die set for closed forging adapted for use with a reciprocating press having a stationary base and a slide, comprising:

a hollow stationary die adapted to be fixed to the stationary base and having a first chamber formed therein;

a first hollow outer piston disposed within said hollow stationary die;

a first metal mold supported by said first hollow outer piston;

a first inner piston slidably mounted within said first hollow outer piston;

a first punch supported by said first inner piston;

said first chamber being adapted to contain hydraulic fluid therein which acts against both said first inner piston and said first outer piston;

a hollow movable die adapted to be fixed to the slide and having a second chamber formed therein;

a second hollow outer piston disposed within said hollow movable die;

a second metal mold supported by said second hollow outer piston;

a second inner piston slidably mounted within said second hollow outer piston;

a second punch supported by said second inner piston;

said second chamber being adapted to contain hydraulic fluid therein which acts against both said second inner piston and said second outer piston;

hydraulic pressure producing means, comprising a primary control piston, for producing a hydraulic pressure due to movement of said primary control piston in response to the pressing of one of said stationary die and said movable die against the other of said stationary die and said movable die; and pressing means, comprising a secondary control piston which has a double piston rod extending therefrom in two opposing directions and is connected to said primary control piston through a closed hydraulic line such that said secondary control piston is caused to move in the same direction as said primary control piston, for pressing respectively against said first outer piston and said second outer piston in response to the production of hydraulic pressure by said hyraulic pressure producing means.

2. A double action die set as recited in claim 1, wherein said first inner piston comprises a ring shaped piston.

3. A double action die set as recited in claim 2, further comprising a rod having one end slidably engaged with said first outer piston, the other end slidably extending through and engaged with said ring-shaped piston and said stationary die, and a flange portion for engaging against a face of said ring-shaped piston and supporting said punch supporting rod.

4. A double action die set as recited in claim 1, wherein said primary control piston and said secondary control piston are mounted to one of said movable die and said stationary die.

5. A double action die set as recited in claim 1, wherein when the reciprocating press is in an open state such that said movable die and said stationary die are separated, a first distance is defined between said first and second metal molds, a second distance is defined between an end of a piston rod of said primary control piston and the opposing one of said movable die and said stationary die, a third distance is defined by a distance between said first outer piston and said second outer piston, at the portions thereof against which said pressing means presses, minus the length of said secondary control piston and its double piston rod, and said first, second and third distances are equal.

6. A double action die set as recited in claim 1, wherein said hollow stationary die is fixed to the stationary base and said hollow movable die is fixed to the slide.

7. A double action die set as recited in claim 1, wherein said first hollow outer piston and said first inner piston are mutually concentrically mounted, and said second hollow outer piston and said second inner piston are mutually concentrically mounted.

8. A double action die set as recited in claim 1, wherein said primary control piston and said secondary control piston are mounted in one of said movable die and said stationary die, and said primary control piston includes a piston rod attached thereto and extending outwardly of said one of said movable die and said stationary die.

9. A double action die set as recited in claim 8, wherein said double piston rod of said secondary control piston extends away from said secondary control piston in a first of said two opposing directions extending outwardly of said one of said movable die and said stationary die and in a second of said two opposing directions extending toward the one of said first and second outer pistons which is disposed in said one of said movable die and said stationary die.

10. A double action die set as recited in claim 1, wherein a pressurized hydraulic line is connected to said secondary control piston at a side thereof opposite the side to which said closed hydraulic line is connected.

11. A double action die set as recited in claim 1, wherein pressurized hydraulic lines are connected to spaces formed within said first and second hollow outer pistons, respectively.

12. A double action die set as recited in claim 1, wherein said first and second chambers formed in said stationary die and said movable die, respectively, are connected to respective hydraulic pressure generators via check valves.

* * * * *